US009830876B2

(12) United States Patent
Zhao

(10) Patent No.: US 9,830,876 B2
(45) Date of Patent: Nov. 28, 2017

(54) CMOS GOA CIRCUIT

(71) Applicants: Shenzhen China Star Optoelectronics Technology Co., Ltd., Shenzhen (CN); Wuhan China Star Optoelectronics Technology Co., Ltd., Wuhan (CN)

(72) Inventor: Mang Zhao, Shenzhen (CN)

(73) Assignees: SHENZHEN CHINA STAR OPTOELECTRONICS TECHNOLOGY CO., LTD., Shenzhen, Guangdong (CN); WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 160 days.

(21) Appl. No.: 14/786,167

(22) PCT Filed: Oct. 10, 2015

(86) PCT No.: PCT/CN2015/091642

§ 371 (c)(1),
(2) Date: Oct. 22, 2015

(87) PCT Pub. No.: WO2017/035906

PCT Pub. Date: Mar. 9, 2017

(65) Prior Publication Data

US 2017/0162152 A1 Jun. 8, 2017

(30) Foreign Application Priority Data

Sep. 2, 2015 (CN) ..... 2015 1 0556373

(51) Int. Cl.
*G09G 3/36* (2006.01)

(52) U.S. Cl.
CPC ..... *G09G 3/3677* (2013.01); *G09G 3/3696* (2013.01); *G09G 2300/0871* (2013.01);
(Continued)

(58) Field of Classification Search
CPC ..... G09G 3/3674; G09G 3/3677; G09G 2310/0286; G09G 3/3696; G09G 2310/08;
(Continued)

(56) References Cited

U.S. PATENT DOCUMENTS

2009/0304139 A1* 12/2009 Tsai ..... G11C 19/28 377/79
2015/0035813 A1* 2/2015 Lei ..... G09G 3/3208 345/205
2015/0356934 A1* 12/2015 Yamashita ..... G09G 3/3611 345/205

* cited by examiner

*Primary Examiner* — Ibrahim Khan
(74) *Attorney, Agent, or Firm* — Leong C. Lei

(57) ABSTRACT

The present invention provides a CMOS GOA circuit. The latch module (3) comprises a NOR gate (Y), and the two input ends of the NOR gate (Y) are respectively inputted with the inverted stage transfer signal (XQ(N)) and the global signal (Gas). When the global signal (Gas) is high voltage level, all the scan driving signals (G(N)) of the respective stages are controlled to be raised up to high voltage levels at the same time, and meanwhile, the NOR gate (Y) is controlled to pull down voltage levels of the stage transfer signals (Q(N)) of the respective stages to clear and reset the stage transfer signals (Q(N)) of the respective stages. In comparison with prior art, an independent reset module is not required. The additional components, wirings, and reset signal are eliminated to reduce the rear of the GOA circuit, and simplify the complexity of the signal, which is beneficial to the design of narrow frame panel; besides, by locating the storage capacitors (7) to store the low voltage level of the stage transfer signal (Q(N)) as all the scan driving signals (G(N)) of the respective stages are raised up to high voltage levels at the same time to promote the stability of the GOA circuit.

11 Claims, 6 Drawing Sheets

(52) U.S. Cl.
CPC ..... *G09G 2310/0289* (2013.01); *G09G 2310/0291* (2013.01); *G09G 2310/08* (2013.01)

(58) Field of Classification Search
CPC ... G09G 2310/0289; G09G 2300/0871; G09G 2310/0291
See application file for complete search history.

CMOS GOA CIRCUIT

FIELD OF THE INVENTION

The present invention relates to a display technology field, and more particularly to a CMOS GOA circuit.

BACKGROUND OF THE INVENTION

The GOA (Gate Driver on Array) technology, i.e. the array substrate row driving technology is to utilize the array manufacture process of the Thin Film Transistor (TFT) liquid crystal display to manufacture the gate driving circuit on the Thin Film Transistor array substrate for realizing the driving way of scanning the gates row by row. It possesses advantages of reducing the production cost and realizing the panel narrow frame design, and is utilized by many kinds of displays. The GOA circuit has two basic functions: the first is to output the scan driving circuit for driving the gate lines in the panel to activate the TFTs in the display areas and to charge the pixels; the second is the shift register function. When the output of the Nth scan driving signal is accomplished, the output of the N+1th scan driving signal is performed with the control of the clock signal, and the transfer carries on in sequence.

With the development of Low Temperature Poly-Silicon (LTPS) semiconductor thin film transistor, the LTPS TFT liquid crystal display gradually becomes the focus that people pay lots of attentions. Because the silicon crystallization of the LTPS has better order than the amorphous silicon, and the LTPS semiconductor has ultra high carrier mobility, the liquid crystal display utilizing the LTPS TFT possesses advantages of high resolution, fast response speed, high brightness, high aperture ratio and et cetera. Correspondingly, the peripheral circuit around the LTPS TFT liquid crystal panel also becomes the focus that people pay lots of attentions.

FIG. 1 shows a CMOS GOA circuit according to prior art, comprising a plurality of GOA units which are cascade connected. The CMOS GOA circuit according to prior art does not only possess the basic scan driving function and the shift register function but also has a function of raising all the scan driving signals of the respective stages up to high voltage levels at the same time (All Gate On).

N is set to be positive integer, and the Nth GOA unit comprises: an input control module 100, a latch module 300, a signal process module 400 and an output buffer module 500.

The input control module 100 receives a stage transfer signal Q(N−1) of the GOA unit circuit of the former stage, a first clock signal CK1, a first inverted clock signal XCK1, a constant high voltage level signal VGH and a constant low voltage level signal VGL, and is employed to input the signal P(N) which the voltage level is opposite to the stage transfer signal Q(N−1) of the GOA unit circuit of the former stage into the latch module 300;

The latch module 300 comprises a inverter F to invert the signal P(N) and obtains the stage transfer signal of the GOA unit circuit of the Nth stage, and the latch module 300 performs latch to the stage transfer signal Q(N);

The signal process module 400 receives the stage transfer signal Q(N), a second clock signal CK2, the constant high voltage level signal VGH, the constant low voltage level signal VGL and the global signal Gas; the signal process module 400 is employed to implement NAND logic process to the second clock signal CK2 and the stage transfer signal Q(N) to generate a scan driving signal G(N) of the GOA unit circuit of the Nth stage; implements NOR Logic process to the global signal Gas with a result of implementing AND logic process to the second clock signal CK2 and the stage transfer signal Q(N) to realize that the global signal Gas controls all the scan driving signals G(N) of the respective stages raised up to high voltage levels at the same time.

The output buffer module 500 is electrically couple to the signal process module 400 and employed to increase a driving ability of the scan driving signal G(N) and to reduce the RC loading in the signal transmission procedure.

In the aforesaid CMOS GOA circuit according to prior art, as achieving the All Gate On function, there is the scan driving signal holding issue. Therefore, the reset and clear process to the voltage level has to be implemented to the stage signal and the scan driving signal before the GOA circuit normal functions. Thus, the GOA unit of the every stage in the CMOS GOA circuit according to prior art further comprises a reset module 200. As shown in FIG. 1, the GOA unit of the Nth stage is illustrated. The reset module 200 further comprises a P-type TFT. The gate of the P-type TFT receives the reset signal Reset, and a source receives a constant high voltage level signal VGH, and a drain is coupled to an input end of the inverter T in the latch module 300. When the reset signal Reset is inputted with a low voltage level, the P-type TFT is conducted, and the inverter F inverts the constant high voltage level signal, and thus pulls down the voltage level of the stage transfer signal Q(N) to clear and reset the stage transfer signal Q(N). The independent reset module 200 can raise the performance of the circuit but the additional components, wirings and signals increase the area of the GOA circuit and raise the complexity of the signals, which makes against the design of narrow frame panel.

SUMMARY OF THE INVENTION

An objective of the present invention is to provide a CMOS COA circuit, which does not only possess the function of raising all the scan driving signals of the respective stages up to high voltage levels at the same time but also can prevent continuation issue of the scan driving signal without utilizing the reset module to reduce the area of the GOA circuit, and simplify the complexity of the signal, which is beneficial to the design of narrow frame panel.

For realizing the aforesaid objective, the present invention provides a CMOS GOA circuit, comprising a plurality of GOA units which are cascade connected;

N is set to be positive integer, and the Nth GOA unit comprises: an input control module, a latch module electrically coupled to the input control module, a signal process module electrically coupled to the latch module, an output buffer module electrically coupled to the signal process module and a storage capacitor electrically coupled to the latch module and the signal process module;

the input control module receives a stage transfer signal of the GOA unit circuit of the former N−1th stage, a first clock signal, a first inverted clock signal, a constant high voltage level signal and a constant low voltage level signal, and is employed to invert the stage transfer signal of the GOA unit circuit of the N−1th stage to obtain an inverted stage transfer signal, and inputs the inverted stage transfer signal to the latch module;

the latch module comprises a NOR gate, and a first input end of the NOR gate is inputted with the inverted stage transfer signal, and a second input end is inputted a global signal, and an output end of the NOR gate outputs the stage transfer signal, and the latch module latches the stage transfer signal;

the signal process module receives the stage transfer signal, a second clock signal, the constant high voltage level signal, the constant low voltage level signal and the global signal, and is employed to implement NAND logic process to the second clock signal and the stage transfer signal to generate a scan driving signal of the GOA unit circuit of the Nth stage; implements NOR Logic process to the global signal with a result of implementing AND logic process to the second clock signal and the stage transfer signal to realize that the global signal controls all the scan driving signals of the respective stages raised up to high voltage levels at the same time;

the output buffer module comprises an odd number of first inverters which are sequentially coupled in series, which are employed to output the scan driving signal and to increase a driving ability of the scan driving signal;

one end of the storage capacitor is electrically coupled to the stage transfer signal, and the other end is grounded, and employed to store a voltage level of the stage transfer signal;

the global signal comprises a single pulse, and as the single pulse is high voltage level, all the scan driving signals of the respective stages are controlled to be raised up to high voltage levels at the same time, and meanwhile, the NOR gate is controlled to pull down voltage levels of the stage transfer signals of the respective stages to clear and reset the stage transfer signals of the respective stages.

The input control module at least comprises a first P-type TFT, a second P-type TFT, a third N-type TFT and a fourth N-type TFT, which are sequentially coupled in series; a gate of the first P-type TFT receives the first inverted clock signal, and a source receives the constant high voltage level signal; both gates of the second P-type TFT and the third N-type TFT receives the stage transfer signal of the GOA unit circuit of the former N−1th stage; the drains of the second P-type TFT and the third N-type TFT are coupled to each other and output inverted stage transfer signal; a gate of the fourth N-type TFT receives the first clock signal, and a source receives the constant low voltage level signal;

the latch module further comprises a fifth P-type TFT, a sixth P-type TFT, a seventh N-type TFT and an eighth N-type TFT, which are sequentially coupled in series; a gate of the fifth P-type TFT receives the first clock signal, and a source receives the constant high voltage level signal; both gates of the sixth P-type TFT and the seventh N-type TFT receives the stage transfer signal; the drains of the sixth P-type TFT and the seventh N-type TFT are coupled to each other and electrically coupled to the drains of the second P-type TFT and the third N-type TFT; a gate of the eighth N-type TFT receives the first inverted clock signal, and a source receives the constant low voltage level signal;

the signal process module further comprises: a ninth P-type TFT, and a gate of the ninth P-type TFT receives the global signal, and a source receives the constant high voltage level signal; a tenth P-type TFT, and a gate of the tenth P-type TFT receives the stage transfer signal, and a source is electrically coupled to the drain of the ninth P-type TFT, and a drain is electrically coupled to a node; an eleventh P-type TFT, and a gate of the eleventh P-type TFT receives the second clock signal, and a source is electrically coupled to the drain of the ninth P-type TFT, and a drain is electrically coupled to the node; a twelfth N-type TFT, and a gate of the twelfth N-type TFT receives the stage transfer signal, and a drain is electrically coupled to the node; a thirteenth N-type TFT, and a gate of the thirteenth N-type TFT receives the second clock signal, and a drain is electrically coupled to the source of the twelfth N-type TFT, and a source receives the constant low voltage level signal; a fourteenth N-type TFT, and a gate of the fourteenth N-type TFT receives the global signal, and a source receives the constant low voltage level signal, and a drain is electrically coupled to the node.

The input control module further comprises a second inverter, and the first inverted clock signal is obtained by inverting the first clock signal with the second inverter.

The output buffer module comprises three first inverters which are sequentially coupled in series, and an input end of the first inverter closet to the signal process module is electrically coupled to the node, and an output end of the first inverter farthest to the signal process module outputs the scan driving signal.

The first inverter is constructed with a fifteenth P-type TFT coupled with a sixteenth N-type TFT in series, and gates of the fifteenth P-type TFT and the sixteenth N-type TFT are electrically coupled to each other to construct the input end of the first inverter, and a source of the fifteenth P-type TFT receives the constant high voltage level signal, and a source of the sixteenth N-type TFT receives the constant low voltage level signal, and drains of the fifteenth P-type TFT and the sixteenth N-type TFT are electrically coupled to each other to construct the output end of the first inverter; an output end of the former first inverter is electrically coupled to an input end of the latter first inverter.

The second inverter is constructed with a seventeenth P-type TFT coupled with an eighteenth N-type TFT in series, and gates of the seventeenth P-type TFT and the eighteenth N-type TFT are electrically coupled to each other to construct the input end of the second inverter, and a source of the seventeenth P-type TFT receives the constant high voltage level signal, and a source of the eighteenth N-type TFT receives the constant low voltage level signal, and drains of the seventeenth P-type TFT and the eighteenth N-type TFT are electrically coupled to each other to construct the output end of the second inverter; the input end of the second inverter receives the first clock signal, and the output end outputs the first inverted clock signal.

The NOR gate comprises a nineteenth P-type TFT, a twentieth P-type TFT, a twenty-first N-type TFT and a twenty-second N-type TFT; gates of the twentieth P-type TFT and the twenty-first N-type TFT are electrically coupled to each other to construct the first input end of the NOR gate; gates of the nineteenth P-type TFT and the twenty-second N-type TFT are electrically coupled to each other to construct the second input end of the NOR gate; a source of the nineteenth P-type TFT receives the constant high voltage level signal, and a drain is electrically coupled to a source of the twentieth P-type TFT; both source of the twenty-first N-type TFT and the twenty-second N-type TFT receives the constant low voltage level signal; drains of the twentieth P-type TFT, the twenty-first N-type TFT and the twenty-second N-type TFT are electrically coupled to one another to construct the output end of the NOR gate.

In the GOA unit of the first stage, both the gates of the second P-type TFT and the third N-type TFT receive a circuit start signal.

The present invention further provides a CMOS GOA circuit, comprising a plurality of GOA units which are cascade connected;

N is set to be positive integer, and the Nth GOA unit comprises: an input control module, a latch module electrically coupled to the input control module, a signal process module electrically coupled to the latch module, an output buffer module electrically coupled to the signal process module and a storage capacitor electrically coupled to the latch module and the signal process module;

the input control module receives a stage transfer signal of the GOA unit circuit of the former N−1th stage, a first clock signal, a first inverted clock signal, a constant high voltage level signal and a constant low voltage level signal, and is employed to invert the stage transfer signal of the GOA unit circuit of the N−1th stage to obtain an inverted stage transfer signal, and inputs the inverted stage transfer signal to the latch module;

the latch module comprises a NOR gate, and a first input end of the NOR gate is inputted with the inverted stage transfer signal, and a second input end is inputted a global signal, and an output end of the NOR gate outputs the stage transfer signal, and the latch module latches the stage transfer signal;

the signal process module receives the stage transfer signal, a second clock signal, the constant high voltage level signal, the constant low voltage level signal and the global signal, and is employed to implement NAND logic process to the second clock signal and the stage transfer signal to generate a scan driving signal of the GOA unit circuit of the Nth stage; implements NOR Logic process to the global signal with a result of implementing AND logic process to the second clock signal and the stage transfer signal to realize that the global signal controls all the scan driving signals of the respective stages raised up to high voltage levels at the same time;

the output buffer module comprises an odd number of first inverters which are sequentially coupled in series, which are employed to output the scan driving signal and to increase a driving ability of the scan driving signal;

one end of the storage capacitor is electrically coupled to the stage transfer signal, and the other end is grounded, and employed to store a voltage level of the stage transfer signal;

the global signal comprises a single pulse, and as the single pulse is high voltage level, all the scan driving signals of the respective stages are controlled to be raised up to high voltage levels at the same time, and meanwhile, the NOR gate is controlled to pull down voltage levels of the stage transfer signals of the respective stages to clear and reset the stage transfer signals of the respective stages;

wherein the input control module at least comprises a first P-type TFT, a second P-type TFT, a third N-type TFT and a fourth N-type TFT, which are sequentially coupled in series; a gate of the first P-type TFT receives the first inverted clock signal, and a source receives the constant high voltage level signal; both gates of the second P-type TFT and the third N-type TFT receives the stage transfer signal of the GOA unit circuit of the former N−1th stage; the drains of the second P-type TFT and the third N-type TFT are coupled to each other and output inverted stage transfer signal; a gate of the fourth N-type TFT receives the first clock signal, and a source receives the constant low voltage level signal;

the latch module further comprises a fifth P-type TFT, a sixth P-type TFT, a seventh N-type TFT and an eighth N-type TFT, which are sequentially coupled in series; a gate of the fifth P-type TFT receives the first clock signal, and a source receives the constant high voltage level signal; both gates of the sixth P-type TFT and the seventh N-type TFT receives the stage transfer signal; the drains of the sixth P-type TFT and the seventh N-type TFT are coupled to each other and electrically coupled to the drains of the second P-type TFT and the third N-type TFT; a gate of the eighth N-type TFT receives the first inverted clock signal, and a source receives the constant low voltage level signal;

the signal process module further comprises: a ninth P-type TFT, and a gate of the ninth P-type TFT receives the global signal, and a source receives the constant high voltage level signal; a tenth P-type TFT, and a gate of the tenth P-type TFT receives the stage transfer signal, and a source is electrically coupled to the drain of the ninth P-type TFT, and a drain is electrically coupled to a node; an eleventh P-type TFT, and a gate of the eleventh P-type TFT receives the second clock signal, and a source is electrically coupled to the drain of the ninth P-type TFT, and a drain is electrically coupled to the node; a twelfth N-type TFT, and a gate of the twelfth N-type TFT receives the stage transfer signal, and a drain is electrically coupled to the node; a thirteenth N-type TFT, and a gate of the thirteenth N-type TFT receives the second clock signal, and a drain is electrically coupled to the source of the twelfth N-type TFT, and a source receives the constant low voltage level signal; a fourteenth N-type TFT, and a gate of the fourteenth N-type TFT receives the global signal, and a source receives the constant low voltage level signal, and a drain is electrically coupled to the node;

wherein the input control module further comprises a second inverter, and the first inverted clock signal is obtained by inverting the first clock signal with the second inverter;

wherein the output buffer module comprises three first inverters which are sequentially coupled in series, and an input end of the first inverter closet to the signal process module is electrically coupled to the node, and an output end of the first inverter farthest to the signal process module outputs the scan driving signal;

wherein the NOR gate comprises a nineteenth P-type TFT, a twentieth P-type TFT, a twenty-first N-type TFT and a twenty-second N-type TFT; gates of the twentieth P-type TFT and the twenty-first N-type TFT are electrically coupled to each other to construct the first input end of the NOR gate; gates of the nineteenth P-type TFT and the twenty-second N-type TFT are electrically coupled to each other to construct the second input end of the NOR gate; a source of the nineteenth P-type TFT receives the constant high voltage level signal, and a drain is electrically coupled to a source of the twentieth P-type TFT; both source of the twenty-first N-type TFT and the twenty-second N-type TFT receives the constant low voltage level signal; drains of the twentieth P-type TFT, the twenty-first N-type TFT and the twenty-second N-type TFT are electrically coupled to one another to construct the output end of the NOR gate;

wherein in the GOA unit of the first stage, both the gates of the second P-type TFT and the third N-type TFT receive a circuit start signal.

The benefits of the present invention are: the present invention provides a CMOS GOA circuit. The latch module comprises a NOR gate, and the two input ends of the NOR gate are respectively inputted with the inverted stage transfer signal and the global signal. When the global signal is high voltage level, all the scan driving signals of the respective stages are controlled to be raised up to high voltage levels at the same time, and meanwhile, the NOR gate is controlled to pull down voltage levels of the stage transfer signals of the respective stages to clear and reset the stage transfer signals of the respective stages. In comparison with prior art, an independent reset module is not required. The additional components, wirings, and reset signal are eliminated to reduce the rear of the GOA circuit, and simplify the complexity of the signal, which is beneficial to the design of narrow frame panel; besides, by locating the storage capacitors to store the low voltage level of the stage transfer signal as all the scan driving signals of the respective stages are raised up to high voltage levels at the same time to promote the stability of the GOA circuit.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
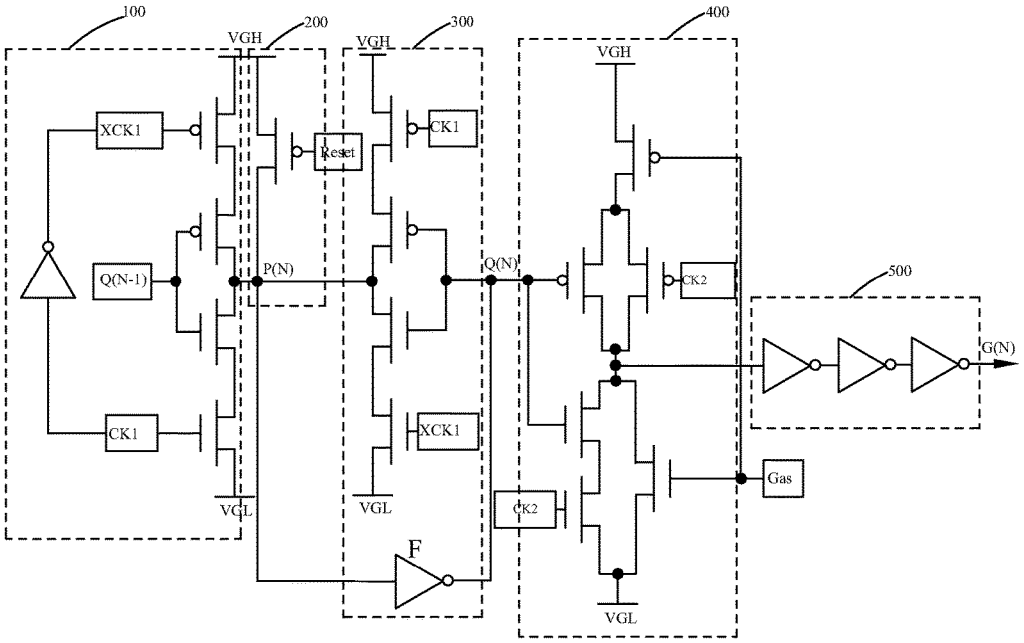
FIG. 1 is a circuit diagram of a CMOS GOA circuit according to prior art.
Figure 2:
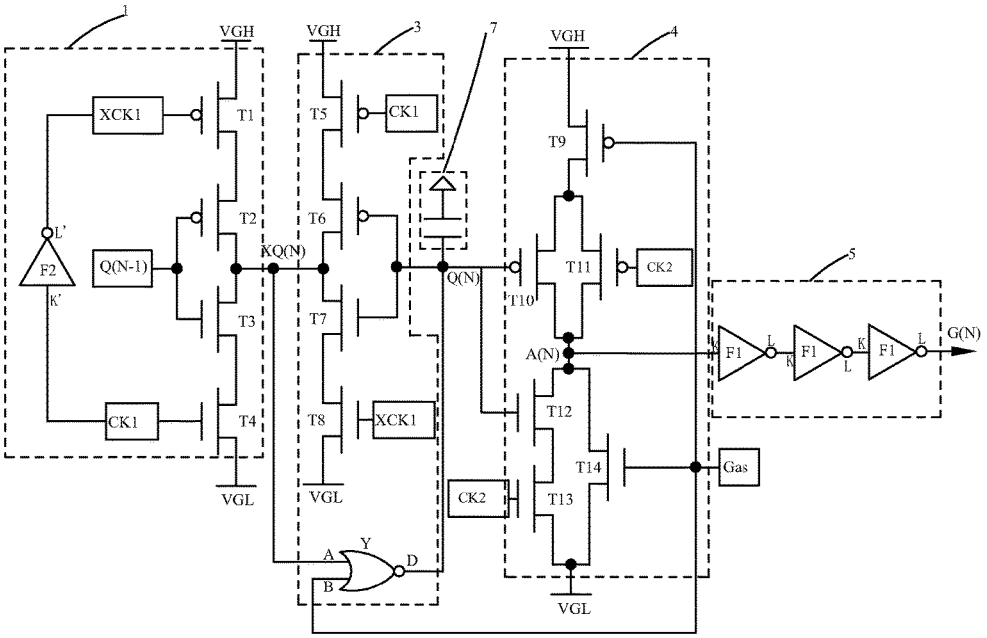
FIG. 2 is a circuit diagram of a CMOS GOA circuit according to the present invention.
Figure 4:
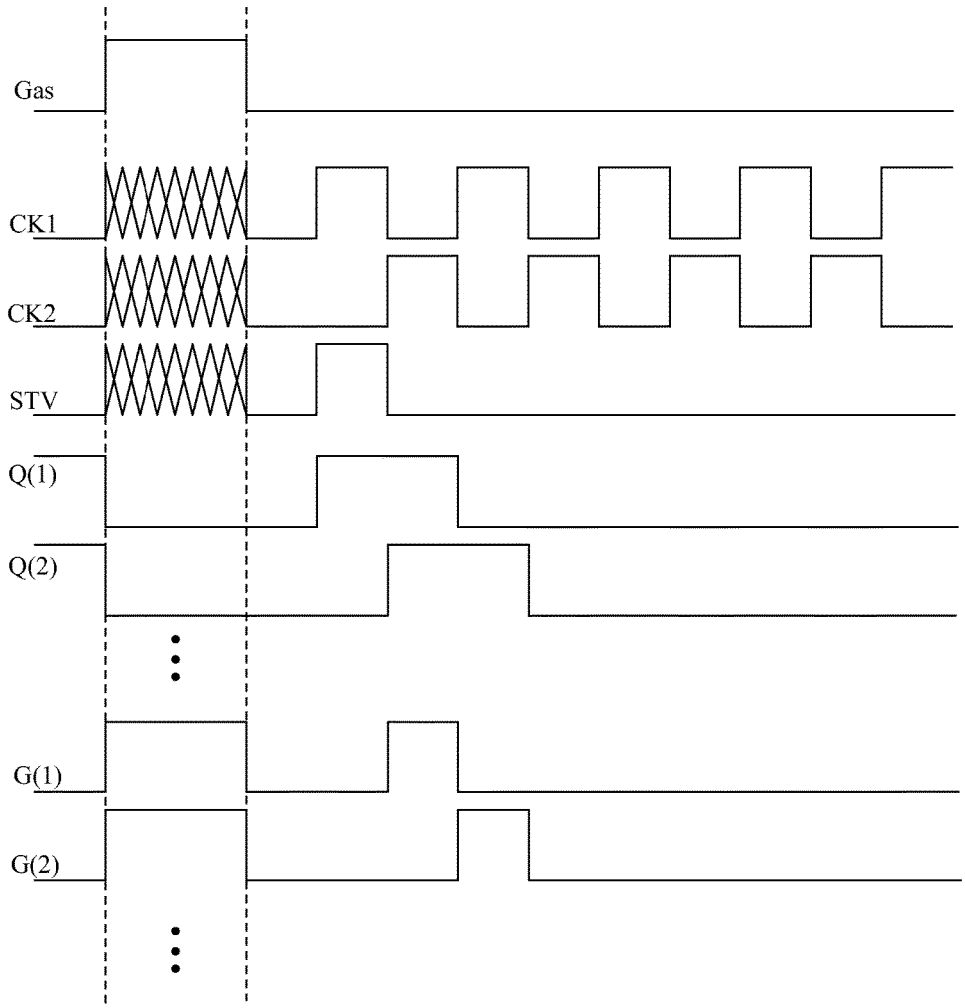
FIG. 4 is a working time sequence diagram of a CMOS GOA circuit according to the present invention.

Please refer to FIG. 2 and FIG. 4. The present invention provides a CMOS GOA circuit, comprising a plurality of GOA units which are cascade connected, and the GOA unit of every stage utilizes a plurality of N-type TFTs and a plurality of P-type TFTs, and respective TFTs are all LTPS thin film transistors. N is set to be positive integer, and the Nth GOA unit comprises: an input control module 1, a latch module 3 electrically coupled to the input control module 1, a signal process module 4 electrically coupled to the latch module 3, an output buffer module 5 electrically coupled to the signal process module 4 and a storage capacitor 7 electrically coupled to the latch module 3 and the signal process module 4.

Figure 6:
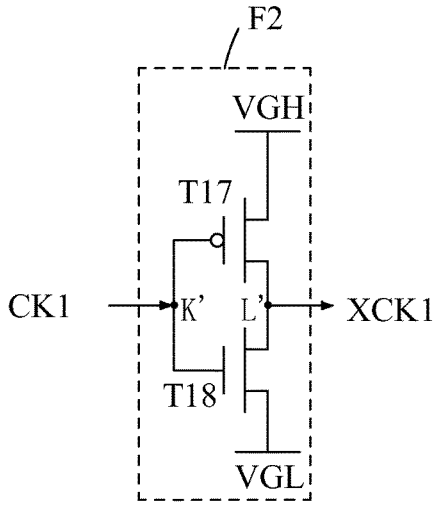
FIG. 6 is a specific circuit structure diagram of a second inverter in an output control module of a CMOS GOA circuit according to the present invention.

The input control module 1 receives a stage transfer signal Q(N−1) of the GOA unit circuit of the former N−1th stage, a first clock signal CK1, a first inverted clock signal XCK1, a constant high voltage level signal VGH and a constant low voltage level signal VGL, and is employed to invert the stage transfer signal Q(N−1) of the GOA unit circuit of the N−1th stage to obtain an inverted stage transfer signal XQ(N), and inputs the inverted stage transfer signal XQ(N) to the latch module 3. Specifically, the input control module 1 at least comprises a first P-type TFT T1, a second P-type TFT T2, a third N-type TFT T3 and a fourth N-type TFT T4, which are sequentially coupled in series; a gate of the first P-type TFT T1 receives the first inverted clock signal XCK1, and a source receives the constant high voltage level signal VGH; both gates of the second P-type TFT T2 and the third N-type TFT T3 receives the stage transfer signal Q(N−1) of the GOA unit circuit of the former N−1th stage; the drains of the second P-type TFT T2 and the third N-type TFT T3 are coupled to each other and output inverted stage transfer signal XQ(N); a gate of the fourth N-type TFT T4 receives the first clock signal CK1, and a source receives the constant low voltage level signal VGL. The input control module 1 further comprises a second inverter F2, and the first inverted clock signal XCK1 is obtained by inverting the first clock signal CK1 with the second inverter F2. Furthermore, the specific circuit structure of the second inverter F2 is shown in FIG. 6, which is constructed with a seventeenth P-type TFT T17 coupled with an eighteenth N-type TFT T18 in series, and gates of the seventeenth P-type TFT T17 and the eighteenth N-type TFT T18 are electrically coupled to each other to construct the input end K' of the second inverter F2, and a source of the seventeenth P-type TFT T17 receives the constant high voltage level signal VGH, and a source of the eighteenth N-type TFT T18 receives the constant low voltage level signal VGL, and drains of the seventeenth P-type TFT T17 and the eighteenth N-type TFT T18 are electrically coupled to each other to construct the output end L' of the second inverter F2; the input end K' of the second inverter F2 receives the first clock signal CK1, and the output end L' outputs the first inverted clock signal XCK1. When the first clock signal CK1 received by the input end K' of the second inverter F2 is high voltage level, the first inverted clock signal XCK1 outputted by the output end L' is low voltage level. When the first clock signal CK1 received by the input end K' of the second inverter F2 is low voltage level, the first inverted clock signal XCK1 outputted by the output end L' is high voltage level. Specifically, the first P-type TFT T1, the second P-type TFT T2, the third N-type TFT T3 and the fourth N-type TFT T4, which are sequentially coupled in series only function normally when the first clock CK1 is high voltage level. If the stage transfer signal Q(N−1) of the GOA unit circuit of the former N−1th stage is high voltage level, the third N-type TFT T3 and the fourth N-type TFT T4 are conducted, and the drain of the third N-type TFT T3 outputs the inverted stage transfer signal XQ(N) of low voltage level; if the stage transfer signal Q(N−1) of the GOA unit circuit of the former N−1th stage is low voltage level, the first P-type TFT T1 and the second P-type TFT T2 are conducted, and the drain of the second P-type TFT T2 outputs the inverted stage transfer signal XQ(N) of high voltage level.

Figure 7:
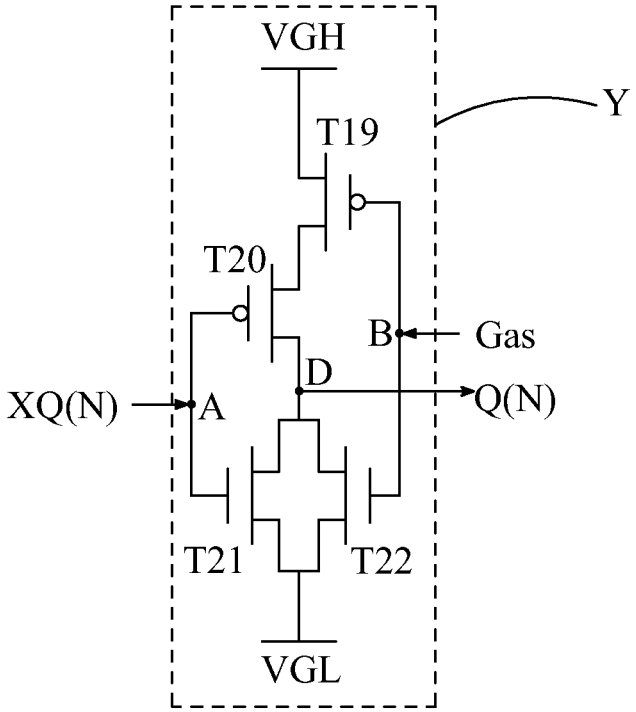
FIG. 7 is a specific circuit structure diagram of a NOR gate in a CMOS GOA circuit according to the present invention.

The latch module 3 comprises a NOR gate Y, and a first input end A of the NOR gate Y is inputted with the inverted stage transfer signal XQ(N), and a second input end B is inputted a global signal Gas, and an output end D of the NOR gate Y outputs the stage transfer signal Q(N). The latch module 3 further comprises a fifth P-type TFT T5, a sixth P-type TFT T6, a seventh N-type TFT T7 and an eighth N-type TFT T8, which are sequentially coupled in series; a gate of the fifth P-type TFT T5 receives the first clock signal CK1, and a source receives the constant high voltage level signal VGH; both gates of the sixth P-type TFT T6 and the seventh N-type TFT T7 receives the stage transfer signal Q(N); the drains of the sixth P-type TFT T6 and the seventh N-type TFT T7 are coupled to each other and electrically coupled to the drains of the second P-type TFT T2 and the third N-type TFT T3; a gate of the eighth N-type TFT T8 receives the first inverted clock signal XCK1, and a source receives the constant low voltage level signal VGL. Furthermore, the specific circuit structure of the NOR gate Y is shown in FIG. 7 and comprises a nineteenth P-type TFT T19, a twentieth P-type TFT T20, a twenty-first N-type TFT T21 and a twenty-second N-type TFT T22; gates of the twentieth P-type TFT T20 and the twenty-first N-type TFT T21 are electrically coupled to each other to construct the first input end A of the NOR gate Y; gates of the nineteenth P-type TFT T19 and the twenty-second N-type TFT T22 are electrically coupled to each other to construct the second input end B of the NOR gate Y; a source of the nineteenth P-type TFT T19 receives the constant high voltage level signal VGH, and a drain is electrically coupled to a source of the twentieth P-type TFT T20; both source of the twenty-first N-type TFT T21 and the twenty-second N-type TFT T22 receives the constant low voltage level signal VGL; drains of the twentieth P-type TFT T20, the twenty-first N-type TFT T21 and the twenty-second N-type TFT T22 are electrically coupled to one another to construct the output end D of the NOR gate Y. When at least one of the inverted stage transfer signal XQ(N) and the global signal Gas inputted into the NOR gate Y is high voltage level, the output end D outputs the stage transfer signal Q(N) of low voltage level. Specifically, the fifth P-type TFT T5, the sixth P-type TFT T6, the seventh N-type TFT T7 and the eighth N-type TFT T8, which are sequentially coupled in series only function normally when the first clock CK1 is high voltage level. If the stage transfer signal Q(N) is high voltage level, then the seventh N-type TFT T7 and the eighth N-type TFT T8 are conducted, and the drain of the seventh N-type TFT T7 outputs low voltage level, i.e. keeps the inverted stage transfer signal XQ(N) to be low voltage level. When the global signal Gas is low voltage level, the stage transfer signal Q(N) outputted by the NOR gate Y remains to be high voltage level to realize the latch to the stage transfer signal Q(N); if the stage transfer signal Q(N) is low voltage level, then the fifth P-type TFT T5 and the sixth P-type TFT T6 are conducted, and the drain of the sixth P-type TFT T6 outputs high voltage level, i.e. keeps the inverted stage transfer signal XQ(N) to be high voltage level or the stage transfer signal Q(N) outputted by the NOR gate Y remains to be low voltage level to realize the latch to the stage transfer signal Q(N).

The signal process module 4 receives the stage transfer signal Q(N), a second clock signal CK2, the constant high voltage level signal VGH, the constant low voltage level signal VGL and the global signal Gas, and is employed to implement NAND logic process to the second clock signal CK2 and the stage transfer signal Q(N) to generate a scan driving signal G(N) of the GOA unit circuit of the Nth stage; implements NOR Logic process to the global signal Gas with a result of implementing AND logic process to the second clock signal CK2 and the stage transfer signal Q(N) to realize that the global signal Gas controls all the scan driving signals G(N) of the respective stages raised up to high voltage levels at the same time. Specifically, the signal process module 4 comprises: a ninth P-type TFT T9, and a gate of the ninth P-type TFT T9 receives the global signal Gas, and a source receives the constant high voltage level signal VGH; a tenth P-type TFT T10, and a gate of the tenth P-type TFT T10 receives the stage transfer signal Q(N), and a source is electrically coupled to the drain of the ninth P-type TFT T9, and a drain is electrically coupled to a node A(N); an eleventh P-type TFT T11, and a gate of the eleventh P-type TFT T11 receives the second clock signal CK2, and a source is electrically coupled to the drain of the ninth P-type TFT T9, and a drain is electrically coupled to the node A(N); a twelfth N-type TFT T12, and a gate of the twelfth N-type TFT T12 receives the stage transfer signal Q(N), and a drain is electrically coupled to the node A(N); a thirteenth N-type TFT T13, and a gate of the thirteenth N-type TFT T13 receives the second clock signal CK2, and a drain is electrically coupled to the source of the twelfth N-type TFT T12, and a source receives the constant low voltage level signal VGL; a fourteenth N-type TFT T14, and a gate of the fourteenth N-type TFT T14 receives the global signal Gas, and a source receives the constant low voltage level signal VGL, and a drain is electrically coupled to the node A(N). moreover, when the global signal is low voltage level: in condition that both the second clock signal CK2 and the stage transfer signal Q(N) are high voltage levels, the twelfth N-type TFT T12 and the thirteenth N-type TFT T13 are conducted, and the voltage level of the node A(N) is low voltage level; in condition that both the second clock signal CK2 and the stage transfer signal Q(N) are low voltage levels, the ninth P-type TFT T9, the tenth P-type TFT T10 and the eleventh P-type TFT T11 are conducted, and the voltage level of the node A(N) is high voltage level. When the global signal is low voltage level, no matter what voltage level the second clock signal CK2 and the stage transfer signal Q(N) are, the fourteenth N-type TFT T14 is conducted, and the voltage level of the node A(N) is low voltage level.

Figure 5:
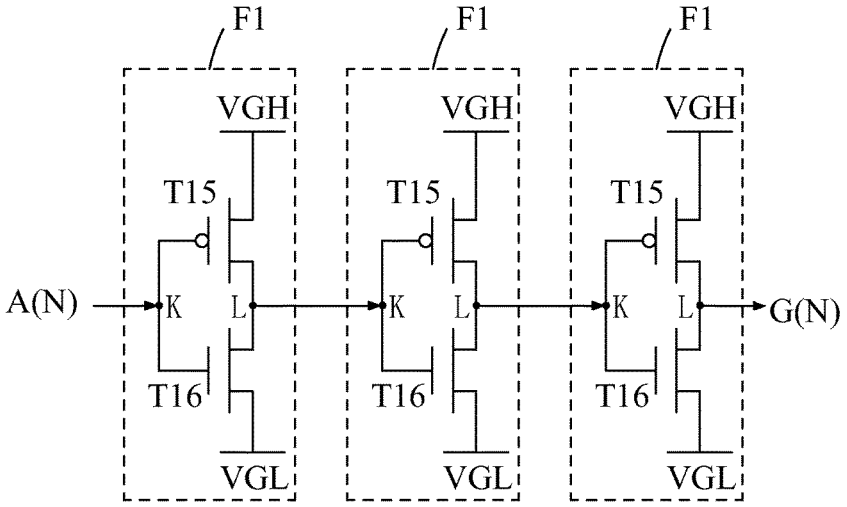
FIG. 5 is a specific circuit structure diagram of three first inverters sequentially in series in an output buffer module of a CMOS GOA circuit according to the present invention.

The output buffer module 5 comprises an odd number of first inverters F1 which are sequentially coupled in series, which are employed to output the scan driving signal G(N) and to increase a driving ability of the scan driving signal G(N). Preferably, the output buffer module 5 comprises three first inverters F1 which are sequentially coupled in series. As shown in FIG. 5, the first inverter F1 is constructed with a fifteenth P-type TFT T15 coupled with a sixteenth N-type TFT T16 in series, and gates of the fifteenth P-type TFT T15 and the sixteenth N-type TFT T16 are electrically coupled to each other to construct the input end K of the first inverter F1, and a source of the fifteenth P-type TFT T15 receives the constant high voltage level signal VGH, and a source of the sixteenth N-type TFT T16 receives the constant low voltage level signal VGL, and drains of the fifteenth P-type TFT T15 and the sixteenth N-type TFT T16 are electrically coupled to each other to construct the output end L of the first inverter F1. An input end of the first inverter F1 closet to the signal process module 4 is electrically coupled to the node A(N), and an output end L of the first inverter F1 farthest to the signal process module 4 outputs the scan driving signal G(N). An output end L of the former first inverter F1 is electrically coupled to an input end K of the latter first inverter F1. When the voltage level of the node A(N) is low voltage level, the scan driving signal G(N) is high voltage level after the backward acting function of the three first inverters F1 which are sequentially coupled in series in the output buffer module 5; when the voltage level of the node A(N) is high voltage level, the scan driving signal G(N) is low voltage level after the backward acting function of the three first inverters F1 which are sequentially coupled in series in the output buffer module 5.

One end of the storage capacitor 7 is electrically coupled to the stage transfer signal Q(N), and the other end is grounded, and employed to store a voltage level of the stage transfer signal Q(N).

Specifically, the global signal Gas comprises a single pulse, and the single pulse is triggered before the GOA circuit normally functions. When the global signal Gas is high voltage level, the fourteenth N-type TFTs T14 in the GOA unit circuits of respective stages are conducted, the voltage levels of the nodes A(N) in the GOA unit circuits of respective stages are low voltage levels, all the scan driving signals G(N) of the respective stages are raised up to high voltage levels at the same time after the backward acting function of the three first inverters F1 which are sequentially coupled in series in the output buffer module 5 in the GOA unit circuits of respective stages; meanwhile, the global signal Gas of high voltage level controls the NOR gate Y to pull down voltage levels of the stage transfer signals Q(N) of the respective stages to clear and reset the stage transfer signals Q(N) of the respective stages. Then, the storage capacitor 7 stores the low voltage level of the stage transfer signal Q(N). After the function of raising all the scan driving signals G(N) of the respective stages up to high voltage levels at the same time finishes, the global signal Gas is changed to be low voltage level. Because the storage capacitor 7 stores the low voltage level, the ninth P-type TFT T9 and the tenth P-type TFT T10 are conducted, and the voltage level of the node A(N) is changed to be high voltage level. All the scan driving signals G(N) of the respective stages are changed to be low voltage levels at the same time after the backward acting function of the three first inverters F1 which are sequentially coupled in series in the output buffer module 5 in the GOA unit circuits of respective stages. The continuation issue of the scan driving signal can be prevented. Then, the COMS GOA circuit normally works.

In comparison with prior art, an independent reset module is not required to the aforesaid CMOS GOA circuit. The additional components, wirings, and reset signal are eliminated to reduce the rear of the GOA circuit, and simplify the complexity of the signal, which is beneficial to the design of narrow frame panel to promote the stability of the GOA circuit.

Significantly, when the global signal Gas is high voltage level, both the first clock signal CK1 and the second clock signal CK2 can be in floating state. Namely, the voltage levels of the first clock signal CK1 and the second clock signal CK2 are not limited to reduce the standby power consumption of the entire circuit. After the global signal Gas is changed from high voltage level to low voltage level, the first clock signal CK1 advances one pulse width than the second clock signal CK2.

Figure 3:
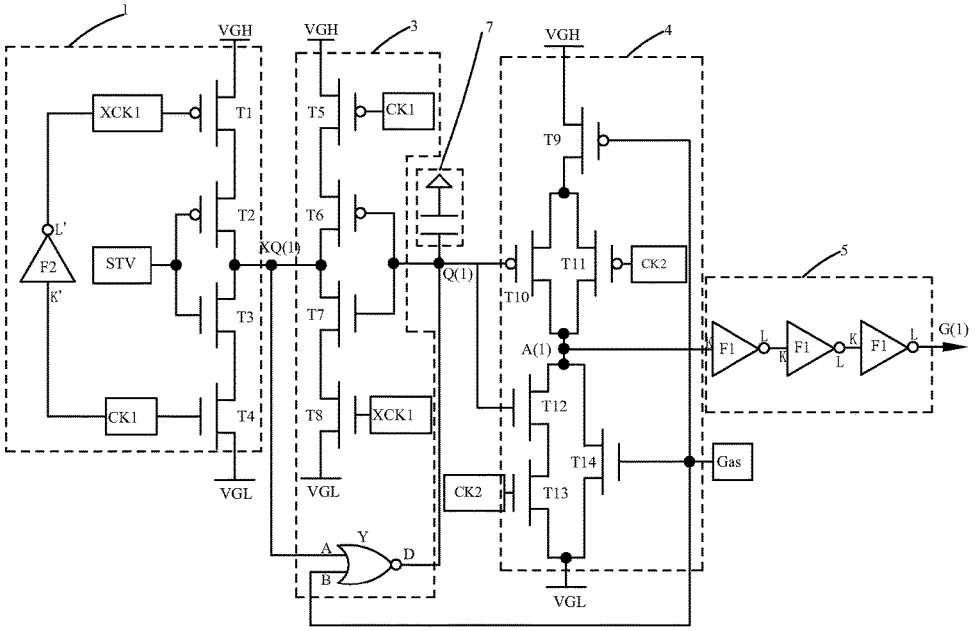
FIG. 3 is a circuit diagram of a first stage GOA unit in a CMOS GOA circuit according to the present invention.

Particularly, as shown in FIG. 3, in the GOA unit of the first stage, both the gates of the second P-type TFT T2 and the third N-type TFT T3 receive a circuit start signal STV. With combination of FIG. 3 and FIG. 4, as the CMOs GOA circuit starts to normally function, the circuit start signal STV and the first clock signal CK1 are high voltage level, and the third N-type TFT T3 and the fourth N-type TFT T4 are conducted, and the drain of the third N-type TFT T3 outputs the inverted stage transfer signal XQ(1) of low voltage level; the stage transfer signal Q(1) outputted by the NOR gate Y of the latch module 3 is high voltage level, and after the first clock signal CK1 is changed to be low voltage level, the high voltage level of the stage transfer signal Q(1) remains to be latched. Then, as the second clock signal CK2 is high voltage level, the twelfth N-type TFT T12 and the thirteenth N-type TFT T13 are conducted, and the voltage level of the node A(1) is low voltage level; the scan driving signal (1) is high voltage level after the backward acting function of the three first inverters F1 which are sequentially coupled in series in the output buffer module 5. Afterward, the GOA unit of the second stage receives the stage transfer signal Q(1) of the GOA unit of the first stage to perform scan driving and so forth until the GOA unit of the last stage accomplishes the scan driving.

In conclusion, the present invention provides a CMOS GOA circuit. The latch module comprises a NOR gate, and the two input ends of the NOR gate are respectively inputted with the inverted stage transfer signal and the global signal. When the global signal is high voltage level, all the scan driving signals of the respective stages are controlled to be raised up to high voltage levels at the same time, and meanwhile, the NOR gate is controlled to pull down voltage levels of the stage transfer signals of the respective stages to clear and reset the stage transfer signals of the respective stages. In comparison with prior art, an independent reset module is not required. The additional components, wirings, and reset signal are eliminated to reduce the rear of the GOA circuit, and simplify the complexity of the signal, which is beneficial to the design of narrow frame panel; besides, by locating the storage capacitors to store the low voltage level of the stage transfer signal as all the scan driving signals of the respective stages are raised up to high voltage levels at the same time to promote the stability of the GOA circuit.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A CMOS GOA circuit, comprising a plurality of GOA units which are cascade connected;

N is set to be positive integer, and the Nth GOA unit comprises: an input control module, a latch module electrically coupled to the input control module, a signal process module electrically coupled to the latch module, an output buffer module electrically coupled to the signal process module and a storage capacitor electrically coupled to the latch module and the signal process module;

the input control module receives a stage transfer signal of the GOA unit circuit of the former N−1th stage, a first clock signal, a first inverted clock signal, a constant high voltage level signal and a constant low voltage level signal, and is employed to invert the stage transfer signal of the GOA unit circuit of the N−1th stage to obtain an inverted stage transfer signal, and inputs the inverted stage transfer signal to the latch module;

the latch module comprises a NOR gate, and a first input end of the NOR gate is inputted with the inverted stage transfer signal, and a second input end is inputted a global signal, and an output end of the NOR gate outputs the stage transfer signal, when at least one of the inverted stage transfer signal and the global signal inputted into the NOR gate is high voltage level, the output end outputs the stage transfer signal of low voltage level; and as stage transfer signal is high voltage level and the global signal is low voltage level, the latch module latches the stage transfer signal and the stage transfer signal outputted by the NOR gate remains to be high voltage level;

the signal process module receives the stage transfer signal, a second clock signal, the constant high voltage level signal, the constant low voltage level signal and the global signal, and is employed to implement NAND logic process to the second clock signal and the stage transfer signal to generate a scan driving signal of the GOA unit circuit of the Nth stage; implements NOR Logic process to the global signal with a result of implementing AND logic process to the second clock signal and the stage transfer signal to realize that the global signal controls all the scan driving signals of the respective stages raised up to high voltage levels at the same time;

the output buffer module comprises an odd number of first inverters which are sequentially coupled in series, which are employed to output the scan driving signal and to increase a driving ability of the scan driving signal;

one end of the storage capacitor is directly coupled to the stage transfer signal, and the other end is directly grounded, and employed to store a voltage level of the stage transfer signal;

the global signal comprises a single pulse, and as the single pulse is high voltage level, all the scan driving signals of the respective stages are controlled to be raised up to high voltage levels at the same time, and meanwhile, the NOR gate is controlled to pull down voltage levels of the stage transfer signals of the respective stages to clear and reset the stage transfer signals of the respective stages and the storage capacitor stores the low voltage level of the stage transfer signal to prevent continuation of the scan driving signal.

2. The CMOS GOA circuit according to claim 1, wherein the input control module at least comprises a first P-type TFT, a second P-type TFT, a third N-type TFT and a fourth N-type TFT, which are sequentially coupled in series; a gate of the first P-type TFT receives the first inverted clock signal, and a source receives the constant high voltage level signal; both gates of the second P-type TFT and the third N-type TFT receives the stage transfer signal of the GOA unit circuit of the former N−1th stage; the drains of the second P-type TFT and the third N-type TFT are coupled to each other and output inverted stage transfer signal; a gate of the fourth N-type TFT receives the first clock signal, and a source receives the constant low voltage level signal;

the latch module further comprises a fifth P-type TFT, a sixth P-type TFT, a seventh N-type TFT and an eighth N-type TFT, which are sequentially coupled in series; a gate of the fifth P-type TFT receives the first clock signal, and a source receives the constant high voltage level signal; both gates of the sixth P-type TFT and the seventh N-type TFT receives the stage transfer signal; the drains of the sixth P-type TFT and the seventh N-type TFT are coupled to each other and electrically coupled to the drains of the second P-type TFT and the third N-type TFT; a gate of the eighth N-type TFT receives the first inverted clock signal, and a source receives the constant low voltage level signal;

the signal process module further comprises: a ninth P-type TFT, and a gate of the ninth P-type TFT receives the global signal, and a source receives the constant high voltage level signal; a tenth P-type TFT, and a gate of the tenth P-type TFT receives the stage transfer signal, and a source is electrically coupled to the drain of the ninth P-type TFT, and a drain is electrically coupled to a node; an eleventh P-type TFT, and a gate of the eleventh P-type TFT receives the second clock signal, and a source is electrically coupled to the drain of the ninth P-type TFT, and a drain is electrically coupled to the node; a twelfth N-type TFT, and a gate of the twelfth N-type TFT receives the stage transfer signal, and a drain is electrically coupled to the node; a thirteenth N-type TFT, and a gate of the thirteenth N-type TFT receives the second clock signal, and a drain is electrically coupled to the source of the twelfth N-type TFT, and a source receives the constant low voltage level signal; a fourteenth N-type TFT, and a gate of the fourteenth N-type TFT receives the global signal, and a source receives the constant low voltage level signal, and a drain is electrically coupled to the node.

3. The CMOS GOA circuit according to claim 2, wherein the input control module further comprises a second inverter, and the first inverted clock signal is obtained by inverting the first clock signal with the second inverter.

4. The CMOS GOA circuit according to claim 2, wherein the output buffer module comprises three first inverters which are sequentially coupled in series, and an input end of the first inverter closet to the signal process module is electrically coupled to the node, and an output end of the first inverter farthest to the signal process module outputs the scan driving signal.

5. The CMOS GOA circuit according to claim 4, wherein the first inverter is constructed with a fifteenth P-type TFT coupled with a sixteenth N-type TFT in series, and gates of the fifteenth P-type TFT and the sixteenth N-type TFT are electrically coupled to each other to construct the input end of the first inverter, and a source of the fifteenth P-type TFT receives the constant high voltage level signal, and a source of the sixteenth N-type TFT receives the constant low voltage level signal, and drains of the fifteenth P-type TFT and the sixteenth N-type TFT are electrically coupled to each other to construct the output end of the first inverter; an output end of the former first inverter is electrically coupled to an input end of the latter first inverter.

6. The CMOS GOA circuit according to claim 3, wherein the second inverter is constructed with a seventeenth P-type TFT coupled with an eighteenth N-type TFT in series, and gates of the seventeenth P-type TFT and the eighteenth N-type TFT are electrically coupled to each other to construct the input end of the second inverter, and a source of the seventeenth P-type TFT receives the constant high voltage level signal, and a source of the eighteenth N-type TFT receives the constant low voltage level signal, and drains of the seventeenth P-type TFT and the eighteenth N-type TFT are electrically coupled to each other to construct the output end of the second inverter; the input end of the second inverter receives the first clock signal, and the output end outputs the first inverted clock signal.

7. The CMOS GOA circuit according to claim 2, wherein the NOR gate comprises a nineteenth P-type TFT, a twentieth P-type TFT, a twenty-first N-type TFT and a twenty-second N-type TFT; gates of the twentieth P-type TFT and the twenty-first N-type TFT are electrically coupled to each other to construct the first input end of the NOR gate; gates of the nineteenth P-type TFT and the twenty-second N-type TFT are electrically coupled to each other to construct the second input end of the NOR gate; a source of the nineteenth P-type TFT receives the constant high voltage level signal, and a drain is electrically coupled to a source of the twentieth P-type TFT; both source of the twenty-first N-type TFT and the twenty-second N-type TFT receives the constant low voltage level signal; drains of the twentieth P-type TFT, the twenty-first N-type TFT and the twenty-second N-type TFT are electrically coupled to one another to construct the output end of the NOR gate.

8. The CMOS GOA circuit according to claim 2, wherein in the GOA unit of the first stage, both the gates of the second P-type TFT and the third N-type TFT receive a circuit start signal.

9. A CMOS GOA circuit, comprising a plurality of GOA units which are cascade connected;

N is set to be positive integer, and the Nth GOA unit comprises: an input control module, a latch module electrically coupled to the input control module, a signal process module electrically coupled to the latch module, an output buffer module electrically coupled to the signal process module and a storage capacitor electrically coupled to the latch module and the signal process module;

the input control module receives a stage transfer signal of the GOA unit circuit of the former N−1th stage, a first clock signal, a first inverted clock signal, a constant high voltage level signal and a constant low voltage level signal, and is employed to invert the stage transfer signal of the GOA unit circuit of the N−1th stage to obtain an inverted stage transfer signal, and inputs the inverted stage transfer signal to the latch module;

the latch module comprises a NOR gate, and a first input end of the NOR gate is inputted with the inverted stage transfer signal, and a second input end is inputted a global signal, and an output end of the NOR gate outputs the stage transfer signal, when at least one of the inverted stage transfer signal and the global signal inputted into the NOR gate is high voltage level, the output end outputs the stage transfer signal of low voltage level; and as stage transfer signal is high voltage level and the global signal is low voltage level, the latch module latches the stage transfer signal and the stage transfer signal outputted by the NOR gate remains to be high voltage level;

the signal process module receives the stage transfer signal, a second clock signal, the constant high voltage level signal, the constant low voltage level signal and the global signal, and is employed to implement NAND logic process to the second clock signal and the stage transfer signal to generate a scan driving signal of the GOA unit circuit of the Nth stage; implements NOR Logic process to the global signal with a result of implementing AND logic process to the second clock signal and the stage transfer signal to realize that the global signal controls all the scan driving signals of the respective stages raised up to high voltage levels at the same time;

the output buffer module comprises an odd number of first inverters which are sequentially coupled in series, which are employed to output the scan driving signal and to increase a driving ability of the scan driving signal;

one end of the storage capacitor is directly coupled to the stage transfer signal, and the other end is directly grounded, and employed to store a voltage level of the stage transfer signal;

the global signal comprises a single pulse, and as the single pulse is high voltage level, all the scan driving signals of the respective stages are controlled to be raised up to high voltage levels at the same time, and meanwhile, the NOR gate is controlled to pull down voltage levels of the stage transfer signals of the respective stages to clear and reset the stage transfer signals of the respective stages and the storage capacitor stores the low voltage level of the stage transfer signal to prevent continuation of the scan driving signal;

wherein the input control module at least comprises a first P-type TFT, a second P-type TFT, a third N-type TFT and a fourth N-type TFT, which are sequentially coupled in series; a gate of the first P-type TFT receives the first inverted clock signal, and a source receives the constant high voltage level signal; both gates of the second P-type TFT and the third N-type TFT receives the stage transfer signal of the GOA unit circuit of the former N−1th stage; the drains of the second P-type TFT and the third N-type TFT are coupled to each other and output inverted stage transfer signal; a gate of the fourth N-type TFT receives the first clock signal, and a source receives the constant low voltage level signal;

the latch module further comprises a fifth P-type TFT, a sixth P-type TFT, a seventh N-type TFT and an eighth N-type TFT, which are sequentially coupled in series; a gate of the fifth P-type TFT receives the first clock signal, and a source receives the constant high voltage level signal; both gates of the sixth P-type TFT and the seventh N-type TFT receives the stage transfer signal; the drains of the sixth P-type TFT and the seventh N-type TFT are coupled to each other and electrically coupled to the drains of the second P-type TFT and the third N-type TFT; a gate of the eighth N-type TFT receives the first inverted clock signal, and a source receives the constant low voltage level signal;

the signal process module further comprises: a ninth P-type TFT, and a gate of the ninth P-type TFT receives the global signal, and a source receives the constant high voltage level signal; a tenth P-type TFT, and a gate of the tenth P-type TFT receives the stage transfer signal, and a source is electrically coupled to the drain of the ninth P-type TFT, and a drain is electrically coupled to a node; an eleventh P-type TFT, and a gate of the eleventh P-type TFT receives the second clock signal, and a source is electrically coupled to the drain of the ninth P-type TFT, and a drain is electrically coupled to the node; a twelfth N-type TFT, and a gate of the twelfth N-type TFT receives the stage transfer signal, and a drain is electrically coupled to the node; a thirteenth N-type TFT, and a gate of the thirteenth N-type TFT receives the second clock signal, and a drain is electrically coupled to the source of the twelfth N-type TFT, and a source receives the constant low voltage level signal; a fourteenth N-type TFT, and a gate of the fourteenth N-type TFT receives the global signal, and a source receives the constant low voltage level signal, and a drain is electrically coupled to the node;

wherein the input control module further comprises a second inverter, and the first inverted clock signal is obtained by inverting the first clock signal with the second inverter;

wherein the output buffer module comprises three first inverters which are sequentially coupled in series, and an input end of the first inverter closet to the signal process module is electrically coupled to the node, and an output end of the first inverter farthest to the signal process module outputs the scan driving signal;

wherein the NOR gate comprises a nineteenth P-type TFT, a twentieth P-type TFT, a twenty-first N-type TFT and a twenty-second N-type TFT; gates of the twentieth P-type TFT and the twenty-first N-type TFT are electrically coupled to each other to construct the first input end of the NOR gate; gates of the nineteenth P-type TFT and the twenty-second N-type TFT are electrically coupled to each other to construct the second input end of the NOR gate; a source of the nineteenth P-type TFT receives the constant high voltage level signal, and a drain is electrically coupled to a source of the twentieth P-type TFT; both source of the twenty-first N-type TFT and the twenty-second N-type TFT receives the constant low voltage level signal; drains of the twentieth P-type TFT, the twenty-first N-type TFT and the twenty-second N-type TFT are electrically coupled to one another to construct the output end of the NOR gate;

wherein in the GOA unit of the first stage, both the gates of the second P-type TFT and the third N-type TFT receive a circuit start signal.

10. The CMOS GOA circuit according to claim 9, wherein the first inverter is constructed with a fifteenth P-type TFT coupled with a sixteenth N-type TFT in series, and gates of the fifteenth P-type TFT and the sixteenth N-type TFT are electrically coupled to each other to construct the input end of the first inverter, and a source of the fifteenth P-type TFT receives the constant high voltage level signal, and a source of the sixteenth N-type TFT receives the constant low voltage level signal, and drains of the fifteenth P-type TFT and the sixteenth N-type TFT are electrically coupled to each other to construct the output end of the first inverter; an output end of the former first inverter is electrically coupled to an input end of the latter first inverter.

11. The CMOS GOA circuit according to claim 9, wherein the second inverter is constructed with a seventeenth P-type TFT coupled with an eighteenth N-type TFT in series, and gates of the seventeenth P-type TFT and the eighteenth N-type TFT are electrically coupled to each other to construct the input end of the second inverter, and a source of the seventeenth P-type TFT receives the constant high voltage level signal, and a source of the eighteenth N-type TFT receives the constant low voltage level signal, and drains of the seventeenth P-type TFT and the eighteenth N-type TFT are electrically coupled to each other to construct the output end of the second inverter; the input end of the second inverter receives the first clock signal, and the output end outputs the first inverted clock signal.

* * * * *